United States Patent [19]

Kimoto et al.

[11] Patent Number: 4,513,597

[45] Date of Patent: Apr. 30, 1985

[54] APPARATUS FOR REDUCING THE WATT LOSS OF A GRAIN-ORIENTED ELECTROMAGNETIC STEEL SHEET

[75] Inventors: Tetsuo Kimoto; Kiyoshi Orita, both of Kitakyushu, Japan

[73] Assignee: Nippon Steel Corporation, Tokyo, Japan

[21] Appl. No.: 398,328

[22] Filed: Jul. 15, 1982

[30] Foreign Application Priority Data

Sep. 30, 1981 [JP] Japan ..... 56-153965

[51] Int. Cl.[3] ..... B21J 22/10

[52] U.S. Cl. ..... 72/53; 51/418; 51/410; 51/310

[58] Field of Search ..... 72/53; 51/418, 417, 51/410, 310, 311, 312, 318; 118/301, 325

[56] References Cited

U.S. PATENT DOCUMENTS 2,195,810 4/1940 Bower ..... 51/418
3,696,565 10/1972 Claeys ..... 51/417

FOREIGN PATENT DOCUMENTS 50-35679 11/1975 Japan .
53-137016 11/1978 Japan .
54-43115 4/1979 Japan .

*Primary Examiner*—Lowell A. Larson
*Assistant Examiner*—Linda McLaughlin
*Attorney, Agent, or Firm*—Kenyon & Kenyon

[57] ABSTRACT

The watt loss of a grain-oriented electromagnetic steel sheet can be reduced by known methods in which serrations or scratches are locally formed on the steel sheet or a small ball or disc is rolled or rotated over the steel sheet. The known methods are disadvantageous in that the rate of production is low and in that the steel sheet has a marked unevenness.

In the present invention, particles, e.g., steel shots, are projected onto substantially linear selected portions of a grain-oriented electromagnetic steel sheet, thereby producing strain in spot-formed regions. An apparatus according to the present invention comprises an endless conveyor and a means for projecting particles. Slits are formed in the endless conveyor, and particles are projected through these slits onto the substantially linear selected portions.

7 Claims, 7 Drawing Figures

21a
POWER SOURCE
21b
POWER SOURCE
26
STRAIN-IMPARTING DEVICE
22a
23a
22b
1
24a
25a
24b
23b
25b
SW1
SW2
27
28
32
INTEGRATOR
PRE-AMPLIFIER
INTEGRATOR
33
MULTIPLIER
29
RECTIFIER
30
34
DIVIDER
DIVIDER
31
SIGNAL GENERATOR FOR SETTING CROSS-SECTIONAL AREA
36
MICRO COMPUTER
REFERENCE-VOLTAGE GENERATOR
OUTPUT 1
OUTPUT 2
OUTPUT 3
35

APPARATUS FOR REDUCING THE WATT LOSS OF A GRAIN-ORIENTED ELECTROMAGNETIC STEEL SHEET

The present invention relates to an apparatus for reducing the watt loss of a grain-oriented electromagnetic steel sheet.

Generally speaking, a grain-oriented electromagnetic steel sheet consists of crystal grains, the direction of easy magnetization, i.e., the [100] axis, of which is parallel to the rolling direction, and grain-orientation of a grain-oriented electromagnetic steel sheet occurs during final annealing, in which secondary recrystallization takes place.

The term "a grain-oriented electromagnetic steel sheet" herein includes a grain-oriented electromagnetic steel sheet in the form of a strip.

Grain-oriented electromagnetic steel sheets which are conventionally produced have either a single orientation, in which the (110) plane and [100] axis of the crystal grains are parallel to the sheet surface and the rolling direction, respectively, or a double orientation, in which the (100) plane and [001] axis of the crystal grains are parallel to the sheet surface and the rolling direction, respectively.

Attempts have been made to enhance the degree of orientation of a grain-oriented electromagnetic steel sheet so that the grain-orientation of all of the crystals of the sheet is virtually ideal, or (110) [001] in the case of a grain-oriented electromagnetic steel sheet having a single orientation, the reason being that, generally speaking, the exciting characteristic is increased and the watt loss is decreased when the degree of orientation is increased. As a result of these attempts, it is now possible to industrially produce a grain-oriented electromagnetic steel sheet which exhibits a magnetic flux density of 1.7 Tesla when the sheet thickness is 0.3 mm. In order to further reduce watt loss, a method different than the method for enhancing the degree of orientation of a grain oriented electromagnetic steel sheet must be employed. In other words, it is difficult to further reduce watt loss only by enhancing the degree of orientation for the reasons given below. The watt loss of a grain-oriented electromagnetic steel sheet is dependent on the exciting characteristic and the grain size. More specifically, the watt loss of a grain-oriented electromagnetic steel sheet can be reduced by enhancing the exciting characteristic and by decreasing the grain size. The exciting characteristic of a grain-oriented electromagnetic steel sheet is usually enhanced by increasing the grain size. The grain size of a grain-oriented electromagnetic steel sheet is conventionally increased by increasing the degree of orientation, but this increase simultaneously involves a factor which disadvantageously increases watt loss and a factor which advantageously decreases watt loss by enhancing the exciting characteristic.

It is known to reduce the watt loss of a grain-oriented electromagnetic steel sheet by applying tension to the sheet surface.

An industrial method for applying tension to the sheet surface involves the application of an insulating film to the steel sheet. The reduction in watt loss due to the application of an insulating film is, however, limited because the tension applied to the sheet surface by the insulating film is limited. The lowest watt loss achieved by means of the industrial tension-applying method mentioned above is approximately 1.03 watts/kg at a frequency of 50 Hz.

It is also known to reduce the watt loss of a grain-oriented electromagnetic steel sheet by means of mirror finishing, such as chemical polishing or electrolytic polishing, occasionally followed by the application of an insulating film to the steel sheet. This method for reducing watt loss is, however, disadvantageous in the respect that watt loss greatly varies depending upon the smoothness of the polished steel sheet. The watt loss of a grain-oriented electromagnetic steel sheet having an insulating film thereon, therefore, also greatly varies because the properties of the insulating film are changed due to the smoothness of the polished steel sheet.

It is proposed in Japanese Published Patent Application No. 50-35679 (1975) that the surface of a grain-oriented electromagnetic steel sheet be serrated or scratched with a knife or an abrasive material so as to reduce watt loss. Serration or scratching unavoidably results in the formation of flaws on a grain-oriented electromagnetic steel sheet and, thus, in an unevenness around the flaws. Consequently, not only is the space factor of the laminated sections of a grain-oriented electromagnetic steel sheet drastically decreased due to the unevenness mentioned above but also the magnetostriction of the steel sheet is drastically increased due to serration or scratching. In addition, burrs, which are formed at both ends of the scratches during scratching, protrude from the sheet surface, and when sections of a grain-oriented electromagnetic steel sheet are laminated, the burrs on said sections protrude through the insulating film applied to the adjacent section. Proposals have been made for eliminating the disadvantages due to serration or scratching and for reducing watt loss to below that attained by enhancing the degree of orientation.

One of the proposals disclosed in Japanese Laid-open Patent Application No. 53-137016 (1978) is that a minute strain be produced in a grain-oriented electromagnetic steel sheet by rolling or rotating a small ball or disc over the steel sheet at a constant pressure. Another proposal disclosed in Japanese Laid-open Patent Application No. 54-43115 (1979) is that a minute strain be produced in a mirror finished grain-oriented electromagnetic steel sheet by rolling or rotating a small ball or disc over the mirror-finished steel sheet. These proposals do, in fact, eliminate the disadvantages due to serration or scratching and reduce watt loss further. However, they still involve problems to be solved from a commercial point of view. One of the problems is that since a small ball or disc is rolled or rotated over a grain-oriented electromagnetic steel sheet so as to produce a minute strain, the steel sheet must either be made stationary or must be conveyed during the production of a minute strain. Another problem is that it is difficult to enhance the production of steel sheets since the relative rolling or rotating speed of a small ball or disc over the grain-oriented electromagnetic steel sheet is limited.

The present inventors and Katsuro Kuroki proposed in a Japanese patent application a method by which the watt loss of a grain-oriented electromagnetic steel sheet is reduced by producing a minute strain in the steel sheet, by which flaws which decrease the space factor of the laminated sections of the steel sheet do not occur, and by which the production of steel sheets is enhanced.

This method for reducing the watt loss of a grain-oriented electromagnetic steel sheet is characterized in that after final annealing of a steel sheet during which grain orientation occurs, particles are projected onto substantially linear selected portions of the grain-oriented electromagnetic steel sheet, thereby producing a strain in the spot-formed regions of said selected portions of the grain-oriented electromagnetic steel sheet.

It is an object of the present invention to provide an apparatus for carrying out the method mentioned above.

An apparatus for projecting particles onto substantially linear selected portions of a grain-oriented electromagnetic steel sheet, thereby producing strain in the spot-formed regions of said selected portions of said grain-oriented electromagnetic steel sheet, according to the present invention, comprises: an endless conveyor in which slits are formed, said slits being spaced a predetermined distance from each other and elongating in the short width direction of the grain-oriented electromagnetic steel sheet, said endless conveyor facing the grain-oriented electromagnetic steel sheet and being movable at a speed synchronous with the transferring speed of the grain-oriented electromagnetic steel sheet; and a means for projecting the particles, said means being located a predetermined distance from the endless conveyor.

The means for projecting particles may be located outside the closed loop of the endless conveyor but is preferably located inside the closed loop of the endless conveyor.

The endless conveyor is usually located below the grain oriented electromagnetic steel sheet being transferred so that the particles are projected upwards and do not blind the slits. However, the endless conveyor may be located above the grain-oriented electromagnetic steel sheet, if there is a means of preventing blinding of the slits, for example, installing the endless conveyor in a slanted position and transferring the electromagnetic steel sheet in a slanted direction.

A grain-oriented electromagnetic steel sheet contains 4.0% or less of silicon and has been subjected to final annealing, during which grain orientation occurs. Therefore, when a grain-oriented electromagnetic steel sheet is subjected to the projection of particles, it may or may not be provided with an insulating film thereon. The insulating film may be a secondary insulating film composed of a phosphate or an organic compound and may have a thickness of from 1 to 5 microns. In addition, the projection of particles may be carried out after a heat-flattening step.

The projection of particles herein indicates projecting the particles only and projecting the particles together with a fluid, such as air or a gas-fluid mixture, by means of a nozzle.

An apparatus according to the present invention preferably comprises:

a means for projecting particles onto substantially linear selected portions of a grain-oriented electromagnetic steel sheet, thereby producing a strain in the spot-formed regions of said substantially linear selected portions;

a pair of means for measuring the watt loss of the grain-oriented electromagnetic steel sheet in front of and behind the projection of particles, as seen in the direction of the pass line; and a watt-loss computing circuit for computing the difference in watt loss due to the projection of particles, comparing said difference with a reference watt loss, and controlling the strain energy imparted to said substantially linear selected portions, said circuit being connected to the pair of means for measuring watt loss.

An apparatus according to an embodiment of the present invention comprises:

a means for projecting particles onto substantially linear selected portions of a grain-oriented electromagnetic steel sheet, thereby producing a strain in the spot-formed regions of said selected portions;

a pair of means for measuring the magnetic flux density, said pair of means being located on the pass line of a grain-oriented electromagnetic steel sheet, one of the means being located in front of said means for projecting particles and the other means being located behind said means for projecting particles, as seen in the direction of the pass line;

a pair of means for applying a magnetic field intensity, said pair of means being located on the pass line of the grain-oriented electromagnetic steel sheet, one of the means being located in front of said means for projecting particles and the other means being located behind said means for projecting particles, as seen in the direction of the pass line; and a watt-loss computing circuit for computing the difference in watt loss due to the projection of particles, comparing said difference with a reference watt loss and controlling the strain energy imparted to said substantially linear selected portions, said circuit being connected to said pair of means for measuring the magnetic flux density and said pair of means for measuring the magnetic field intensity.

An apparatus according to the present invention preferably further comprises a magnetic-flux density computing circuit for comparing the magnetic flux density of a grain-oriented electromagnetic steel sheet with a predetermined reference magnetic flux density and for controlling the range of the strain energy.

As the projected particles, steel shots, other metal shots, organic resin particles, ceramic particles, and plant material particles can be used. The particles should be an essentially sphercical shape.

Embodiments of the present invention are hereinafter explained with reference to the drawings, wherein.

Figure 1:
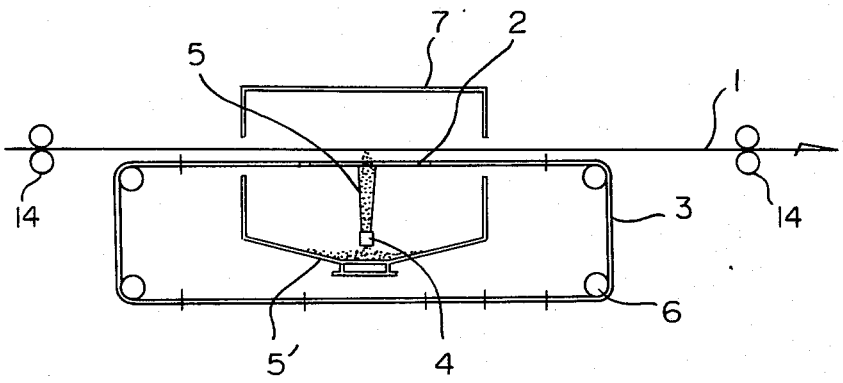
FIG. 1 is a side cross-sectional view of an embodiment of an apparatus according to the present invention.

In FIGS. 1 through 3 and 7, a grain-oriented electromagnetic steel sheet is denoted by 1 and is hereinafter simply referred to as steel sheet 1.

Steel sheet 1 is transferred by means of a conveyor 13, (FIG. 7), pinch rollers 14 (FIG. 1) or another transferring machine (not shown) in the direction indicated by the arrow (FIGS. 1 and 2) and along a pass line. Endless belt loop 3, in which slits 2 are formed, is installed below the pass line of steel sheet 1 and faces steel sheet 1. Slits 2 are spaced a predetermined distance from each other and elongate in the short width direction of steel sheet 1, i.e., the direction perpendicular to the drawings. Steel sheet 1 may be located directly on endless conveyor 13 having spaced apart slits 12. A means for projecting particles is installed at a predetermined distance from steel sheet 1.

Centrifugal force is imparted to the particles, i.e., steel shots 5 (FIG. 1), 5*a* and 5*b* (FIG. 2), and 5*c* and 5*d* (FIG. 3) by impeller 4 or impellers 4*a* and 4*b* or 4*c* and 4*d*, and steel shots 5, 5*a*, 5*b*, 5*c*, and 5*d* are projected onto one of the surfaces of steel sheet 1, i.e., the bottom surface of steel sheet 1. Slits 2 formed in portions of endless belt loop 3, allow steel shots 5, 5*a*, and 5*b* to pass therethrough, and the other portions of endless conveyor 3 are shielded from steel shots 5, 5*a*, and 5*b*. Therefore, steel shots 5, 5*a*, 5*b*, 5*c*, and 5*d* are not projected onto the entire bottom surface of steel sheet 1; rather, they are projected onto only selected portions of the bottom surface of steel sheet 1, toward which portions slits 2 are oriented. Since slits 2 elongate in the short width direction of steel sheet 1, said selected portions are substantially linear. In addition, since a number of steel shots 5, 5*a*, 5*b*, 5*c*, and 5*d* impinge upon the selected portions, a number of minute spotlike indentations are formed and strain is generated in minute spot-formed regions.

Endless conveyor 13 or belt loop 3 is driven by and is occasionally subjected to tension by rolls 6.

Steel shots 5 (FIG. 1) are projected vertically upwards through slits 2 onto steel sheet 1. Steel shots 5*a* and 5*b* (FIG. 2) and 5*c* and 5*d* (FIG. 3) are projected upwards but not vertically by impellers 4*a* and 4*b* (FIG. 2) and impellers 4*c* and 4*d* (FIG. 3), respectively, which are in a slanted position. Impeller 4 and impellers 4*a* and 4*b* and 4*c* and 4*d* are located inside cabin 7 of a shot-blasting machine, but they may be located outside cabin 7.

Steel shots 5, 5*a*, 5*b*, 5*c*, and 5*d*, which impinge on endless conveyor 13 or belt loop 3 or steel sheet 1, are collected at the bottom part of cabin 7 and are circulated for recycling by means of a collecting and circulating apparatus (not shown).

Steel shots are conventionally used to descale rolled steel products. The impinging force of the steel shots according to the present invention may not be as great as in the case of descaling, but an impinging force great enough to lightly strike the surface of steel sheet 1 is sufficient to decrease watt loss. The impinging force can be optionally adjusted depending upon the projection rate, the size, the material, and the hardness of the particles and upon the width of slits, as well as upon the tension which may be applied to steel sheet 1 being transferred. As in every method for producing strain in a grain-oriented electromagnetic steel sheet, a very large strain does not decrease watt loss but instead increases watt loss.

Figure 4:
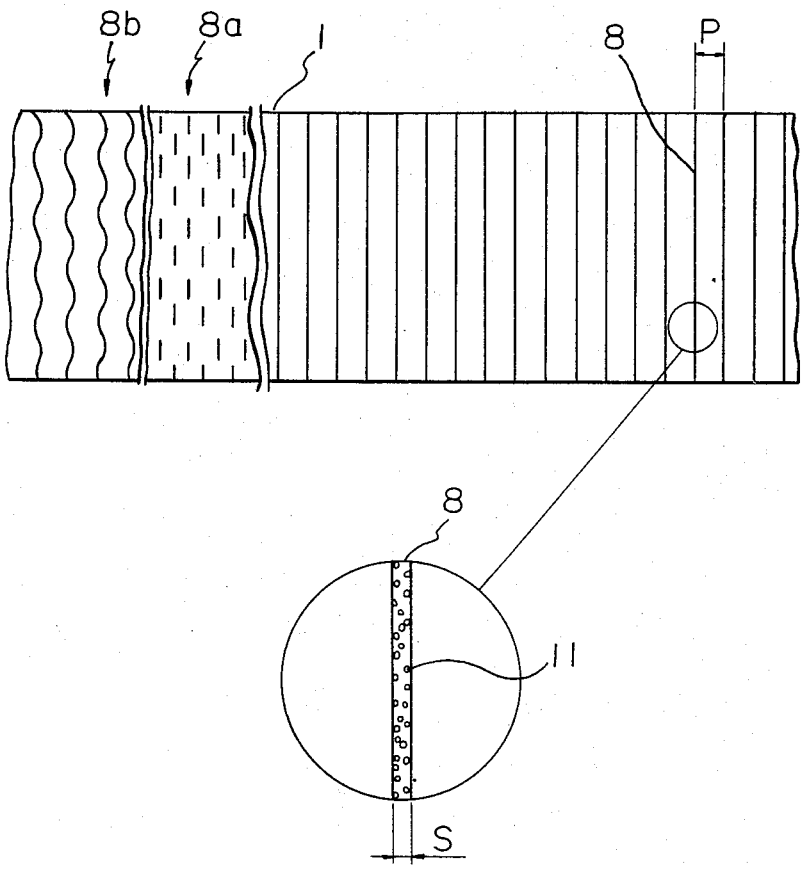
FIG. 4 shows embodiments of the substantially linear selected portions of a grain-oriented electromagnetic steel sheet in which strain is produced due to the projection of particles.

In FIG. 4, a number of selected portions 8 of steel sheet 1 are linear, are substantially perpendicular to the rolling direction of steel sheet 1, and are parallel to one another. Each of selected portions 8 is a continuous line or curve. Also, each of selected portions 8 may be a discontinuous line 8*a* or a curve 8*b*.

Figure 2:
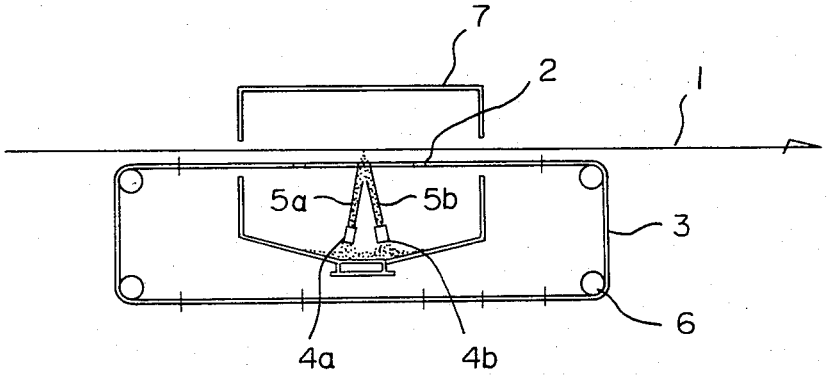
FIG. 2 is a view similar to FIG. 1.
Figure 3:
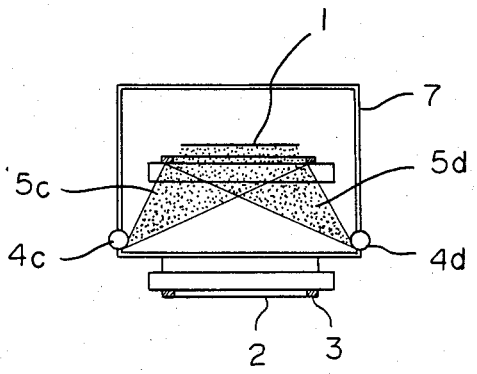
FIG. 3 is a front cross-sectional view of an embodiment of an apparatus according to the present invention.

The width (s) of selected portions 8 is preferably from 0.1 to 0.3 mm. Spotlike indentations are indicated in FIG. 4 by reference numeral 11. The surface area of spotlike indentations 11 is considerably smaller than that of selected portions 8, and spotlike indentations 11 have a diameter of from 60 to 80 microns and a depth of from 3 to 5 microns. It is important that the dimensions of spotlike indentations 11 be small and narrow so as to reduce the watt loss of steel sheet 1. Steel sheet 1 has no burrs around spotlike indentations 11 because spotlike indentations 11 are formed by the projection of steel shots 5, 5*a*, 5*b*, 5*c*, and 5*d* (FIGS. 1 through 3). The regions of steel sheet 1 where strain is produced are substantially linear. Strictly speaking, such regions are defined by a number of small spot-formed regions which are substantially linearly arranged. Although selected portions 8 are linear and are substantially perpendicular to the rolling direction, the selected portions of a grain-oriented electromagnetic steel sheet having any other pattern may be subjected to the projection of particles. For example, discontinuous or continuous portions, which extend linearly or non-linearly in the rolling direction, may be subjected to the projection of particles.

When steel sheet 1 has an insulating film (not shown) applied thereon prior to the projection of particles, spotlike indentations 11 do not seriously damage the insulating film. In addition, a marked reduction in watt loss is attained for example, approximately 0.08 watts/kg in terms of $W_{17/50}$, while at the same time the space factor of the laminated sections of steel sheet 1 is not markedly reduced due to spotlike indentations 11.

The distance between selected portions 8, hereinafter referred to as the linear-strain pitch (p), is optionally selected in the range of from 3 to 10 mm. The linear-strain pitch (p) can be adjusted by adjusting the distance between slits 2.

The apparatus according to the present invention is practical, simple, and inexpensive from the point of view of installation costs. Since steel shots 5, 5*a*, 5*b*, 5*c*, and 5*d* can be recovered by means of a collecting and circulating apparatus, the cost of projecting particles by means of the apparatus of the present invention is very low.

Figure 6:
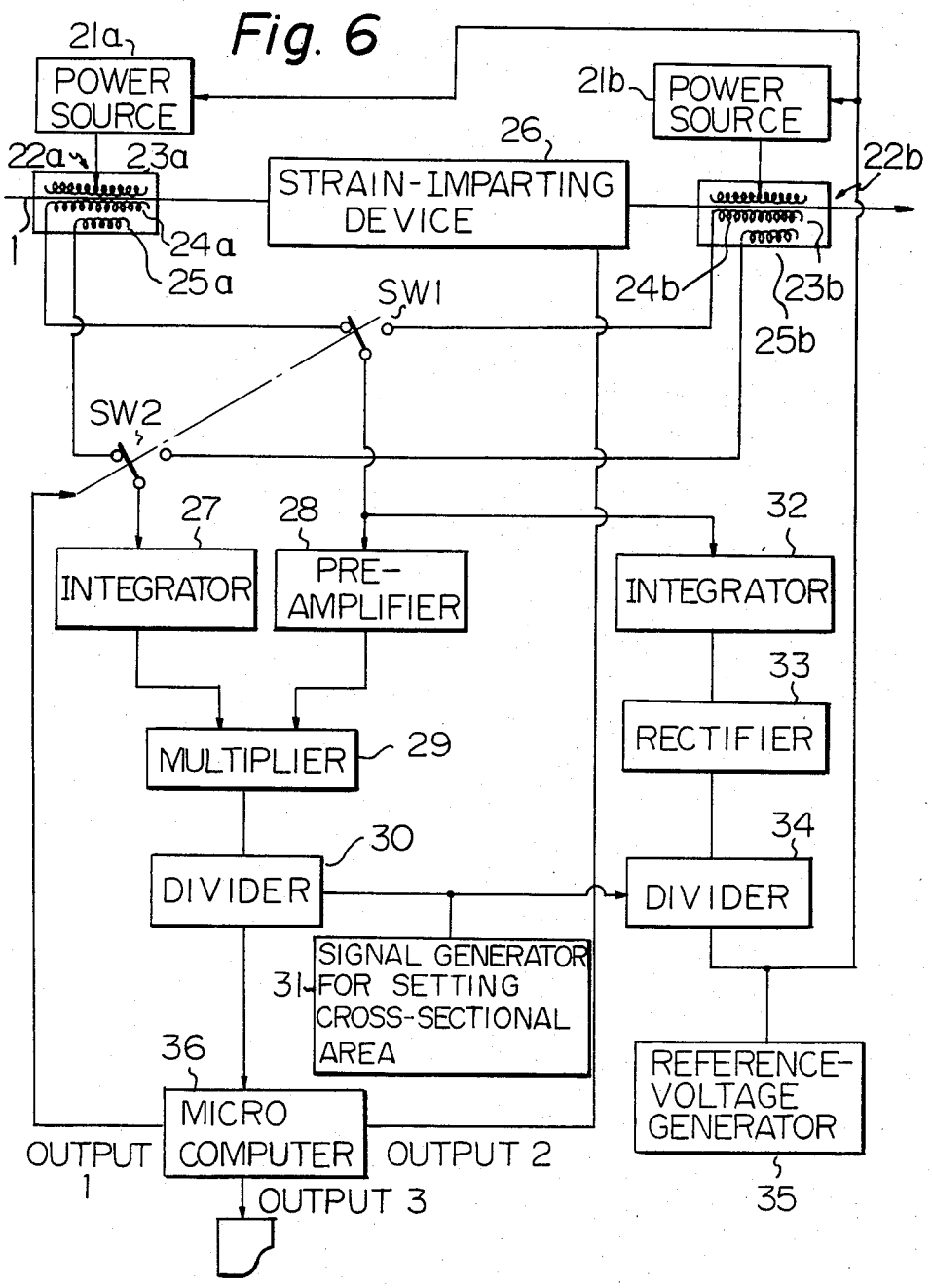
FIG. 6 is a block diagram of an embodiment of an apparatus comprising a watt-loss computing circuit.
Figure 7:
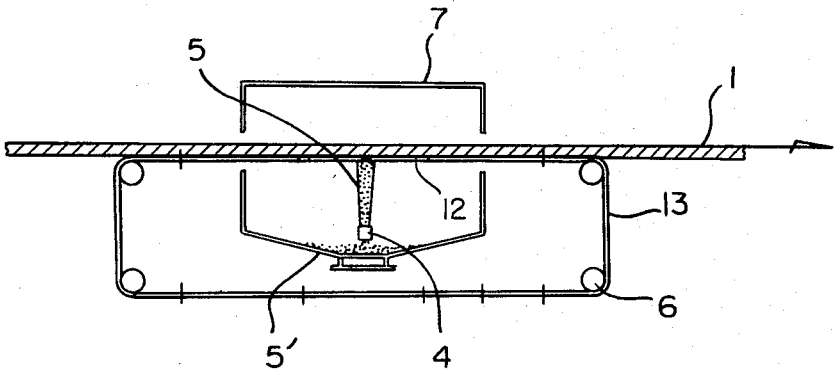
FIG. 7 is a side view illustrating an embodiment of the present invention wherein the grain-oriented electromagnetic steel sheet is transported on an endless conveyor means.

In FIG. 6 a block diagram of an embodiment of an apparatus comprising a watt-loss circuit is shown. Power sources 21*a* and 21*b* comprise an oscillation mechanism having a commercial frequency and energize exciting coils 23*a* and 23*b* of detecting devices 22*a* and 22*b*, respectively.

Detecting devices 22*a* and 22*b*, respectively, comprise coils 24*a* and 24*b* for measuring the magnetic flux density of steel sheet 1 and coils 25*a* and 25*b* for applying the magnetic field intensity according to a predetermined measuring condition. Integrator 27 integrates the magnetic field intensity with regard to time, and then the voltage generated due to the magnetic flux density, which voltage is amplified by preamplifier 28, and the integrated voltage, which is generated due to the magnetic field intensity, are multiplied by multiplier 29. The output of multiplier 29 is divided by the output signal of signal generator 31 for setting the cross-sectional area so as to obtain the watt loss of steel sheet 1 before the projection of particles. Microcomputer 36 subtracts the obtained watt loss from a watt-loss reference signal and produces OUTPUT 2. The watt-loss computing circuit consists of integrator 27, preamplifier 28, multiplier 29, divider 30, signal generator 31 for setting the cross-sectional area, integrator 32, rectifier 33, divider 34 and microcomputer 36. OUTPUT 2 of microcomputer 36 is transmitted to first means 26, i.e., the strain-imparting device.

Integrator 32 integrates an induction voltage of coil 24*a* for measuring the magnetic flux density, and the integrated induction voltage is rectified by rectifier 33. The magnetic flux density of steel sheet 1 is obtained by divider 34 which divides the output signal of rectifier 33 by the output signal of signal generator 31 for setting the cross-sectional area.

Divider 34 and reference-voltage generator 35 form a negative feedback circuit for controlling the magnetic flux density and power sources 21*a* and 21*b*.

Strain-imparting device 26 may be any means for projecting particles onto selected portions of steel sheet 1, thereby producing a strain in the spot-formed regions of said substantially linear selected portions. One detecting device 22*a* is located on the pass line of steel sheet 1 in front of strain-imparting device 26, as seen in the direction of the pass line, and the other detecting device 22*b* is located on the pass line of steel sheet 1 behind strain-imparting device 26, as seen in the direction of the pass line.

Microcomputer 36 generates a signal for periodically switching switches $SW_1$ and $SW_2$ and controls strain-imparting device 26 in such a manner that: after microcomputer 36 receives the output signal of divider 30, the watt loss of steel sheet 1 after the projection of particles is subtracted from that before the projection of particles so as to obtain the difference in watt loss; when this difference indicates a decrease in watt loss, the strain-imparting force is maintained or adjusted to further increase such difference; and when this difference indicates an increase in watt loss, the strain-imparting force is adjusted so as to decrease watt loss. Strain-imparting device 26 or the strain energy may be controlled by adjusting the particle projection rate. The particle projection rate is preferably from 25 to 30 meters/sec when the magnetic flux density ($B_8$) of steel sheet 1 is approximately 1.95 and is preferably from 20 to 25 meters/sec when the magnetic flux density ($B_8$) of steel sheet 1 is approximately 1.92 Tesla. OUTPUT 3 of microcomputer 36 is typed out on an output format, and the watt loss before and after the projection of particles, as well as the transferring length of steel sheet 1 given in this output format, is used as information in the further treatment of steel sheet 1.

The present invention is further explained by way of an example.

EXAMPLE

The projection of particles was carried out by means of the apparatus shown in FIG. 3.

Steel sheet 1 had a thickness of 0.30 mm and had the following magnetic properties before the projection of particles:

$W_{17/50}$:1.00~1.10 watts/kg $B_8$: 1.93~1.96 Tesla.

$W_{17/50}$ is the watt loss at a magnetic flux density of 1.7 Tesla and at a frequency of 50 Hz. The conditions under which particles were projected were as follows:

Kind of particles: steel shots 5*c* and 5*c*

Nominal diameter of steel shots 5*c* and 5*d*: 0.3 mm

Actual diameter of steel shots 5*c* and 5*d*: from 0.1 to 0.4 mm

Projection rate: from 3 to 30 kg/min/m$^2$

Figure 5:
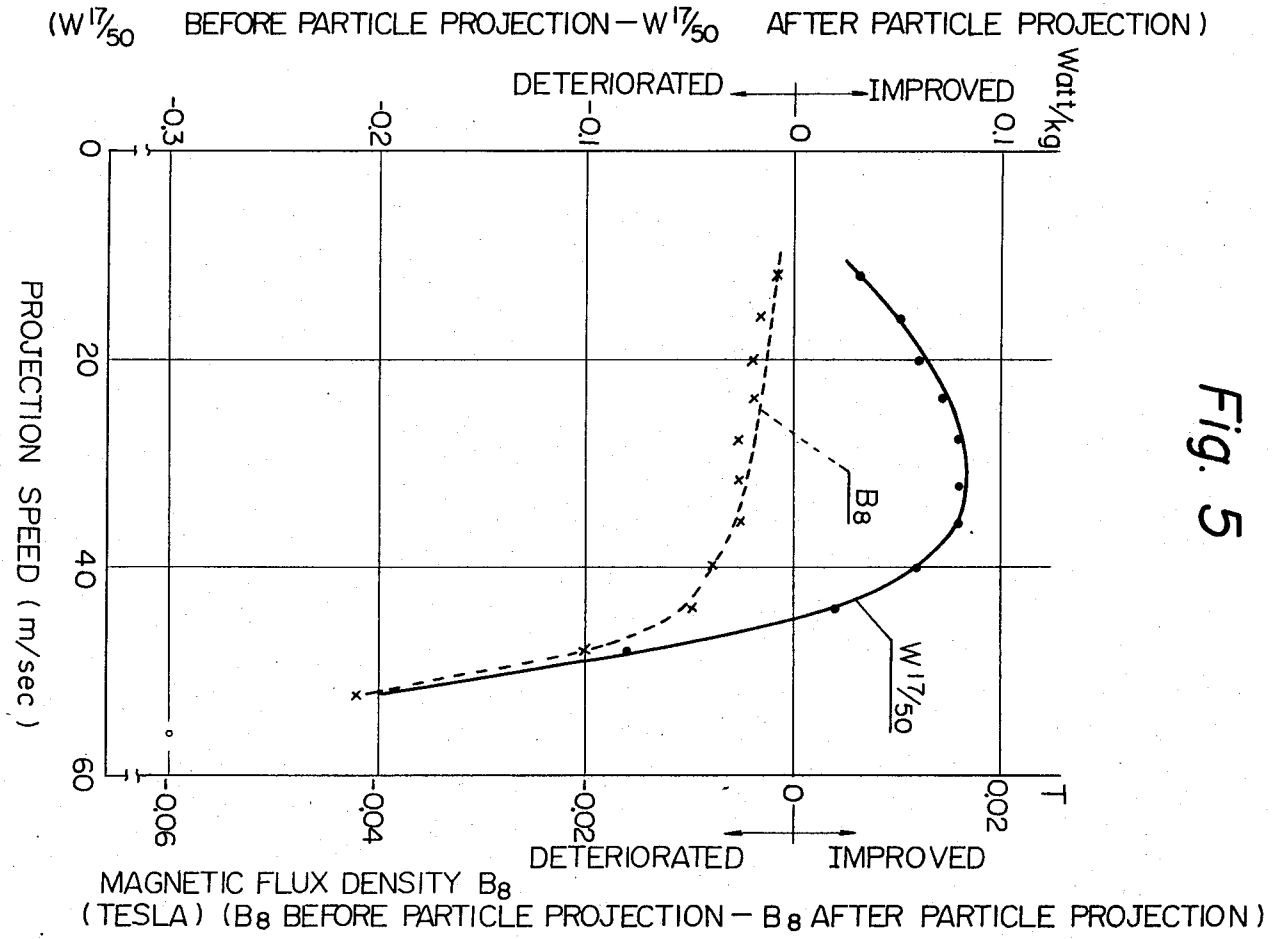
FIG. 5 is a graph showing the magnetic flux density ($B_8$) and the watt loss ($W_{17/50}$) obtained as a result of the projection of particles.

Projection speed (speed of steel shots 5*c* and 5*d*): from 12 to 52 meters/sec Linear-strain pitch (P) (distance between slits 2): 10 mm Width of slits 2: approximately 0.7 mm Transferring speed of steel sheet 1: from 0.3 to 3.0 meters/min $W_{17/50}$, which was measured by SST (measurement of a single sheet), and $B_8$ are given in FIG. 5. As is apparent from FIG. 5, when the projection speed was appropriately selected, $W_{17/50}$ was reduced as compared with $W_{17/50}$ before the projection of particles so that a very low watt loss was achieved. $B_8$ was slightly reduced at a projection speed at which a reduction in $W_{17/50}$ was achieved. Such a slight reduction in $B_8$ practically involves no problem.

We claim:

1. An apparatus for projecting particles onto substantiallly linear selected portions of a grain-oriented electromagnetic steel sheet, thereby producing strain in the spot-formed regions of said selected portions of said grain-oriented electromagnetic steel sheet, comprising:

means for transferring a grain-oriented electromagnetic steel sheet along a predetermined path;

an endless belt loop in which slits are formed, said slits being spaced at a predetermined distance from each other and elongated in the direction perpendicular to said path with said endless belt loop facing said path and movable at a speed synchronous with the transferring speed of said grain-oriented electromagnetic steel sheet; and means for projecting particles, said means being located adjacent said belt loop portion and oriented to project particles toward said belt loop portion and thereby said path.

2. An apparatus according to claim 1, wherein said endless belt loop is located below said predetermined path.

3. An apparatus according to claim 1 or 2 further including a shot blasting machine having a cabin wherein said means for projecting particles is located inside the cabin.

4. An apparatus according to claim 1 or 2 further including a shot blasting machine having a cabin wherein said means for projecting particles is located outside the cabin.

5. An apparatus according to claim 1 or 2, wherein said means for projecting particles is an impeller.

6. An apparatus according to claim 1 or 2, wherein said means for projecting particles is a nozzle.

7. An apparatus for projecting particles onto substantially linear selected portions of a grain-oriented electromagnetic steel sheet, thereby producing strain in the spot-formed regions of said selected portions of said grain-oriented steel sheet, comprising:

an endless conveyor having the grain-oriented electromagnetic steel sheet disposed on a portion thereof and operable for transferring said sheet through a predetermined path; wherein said endless conveyor has slits formed therein with said slits being spaced at a predetermined distance from each other and elongated in the direction perpendicular to said path; and means for projecting particles, said means being located adjacent said portion of said conveyor and oriented to project particles toward said portion of said conveyor and thereby said path.

* * * * *

UNITED STATES PATENT AND TRADEMARK OFFICE

CERTIFICATE OF CORRECTION

PATENT NO. : 4,513,597

DATED : April 30, 1985

INVENTOR(S) : T. Kimoto, et al.

It is certified that error appears in the above-identified patent and that said Letters Patent is hereby corrected as shown below:

Column 4, line 40, change "sphercical" to --spherical--.

Column 4, line 56, after "particles;" add the word --and--.

Signed and Sealed this

*Twenty-ninth* Day of *October 1985*

[SEAL]

*Attest:*

DONALD J. QUIGG

*Attesting Officer*

*Commissioner of Patents and Trademarks—Designate*